US006006726A

United States Patent [19]

Mai et al.

[11] Patent Number: 6,006,726

[45] Date of Patent: Dec. 28, 1999

[54] METHOD AND DEVICE FOR CYLINDER RECOGNITION IN AN INTERNAL COMBUSTION ENGINE

[75] Inventors: Udo Mai, Untergriesbach; Ekkehard Kollmann; Roman Schichl, both of Passau, all of Germany

[73] Assignee: Vogt electronic AG, Obernzell, Germany

[21] Appl. No.: 09/020,062

[22] Filed: Feb. 6, 1998

[30] Foreign Application Priority Data

Dec. 19, 1996 [DE] Germany ..... 196 52 896

[51] Int. Cl.[6] ..... F02P 5/00

[52] U.S. Cl. ..... 123/406.26; 123/406.58

[58] Field of Search ..... 123/406.26, 406.27, 123/406.28, 406.58; 324/380

[56] References Cited

U.S. PATENT DOCUMENTS

| | | | |
|---|---|---|---|
| 4,377,140 | 3/1983 | Latsch | 123/406.26 |
| 4,889,094 | 12/1989 | Beyer et al. . | |
| 5,263,451 | 11/1993 | Andreasson | 123/406.26 |
| 5,349,299 | 9/1994 | Kanchiro et al. . | |
| 5,544,635 | 8/1996 | Hara et al. | 123/406.26 |
| 5,563,515 | 10/1996 | Kako | 324/391 |
| 5,572,973 | 11/1996 | Schenk | 123/414 |
| 5,611,311 | 3/1997 | Tomisawa | 123/406.58 |
| 5,676,113 | 10/1997 | Johansson et al. | 123/406.26 |
| 5,775,298 | 7/1998 | Haller | 123/406.27 |

*Primary Examiner*—John Kwon
*Attorney, Agent, or Firm*—Foley, Hoag & Eliot LLP

[57] ABSTRACT

The present invention provides a device and a method for cylinder sensing in an internal combustion engine. The device according to the invention has a crankshaft sensor device for detecting a crank angle and a predetermined crankshaft position, and outputting corresponding crankshaft signals; an ignition device for igniting the respective cylinder of the internal combustion engine by generating corresponding high-voltage pulses for corresponding control signals, and a control device for receiving the crankshaft signals and outputting the control signals to the ignition device as a function of at least the crankshaft signals, with the control device being so designed that in a cylinder sensing phase, while receiving a crankshaft signal corresponding to a predetermined crankshaft position, it outputs a control signal to generate a high-voltage pulse with a predetermined amplitude that can be reached in at least one specific cylinder; an ignition detection device for determining whether and/or at what ignition voltage the specific cylinder was ignited by the high-voltage pulse and outputting a corresponding ignition detection signal; and a cylinder sensing device for determining whether the specific cylinder is in the predetermined crankshaft position in its power stroke, based on at least the ignition acquisition signal.

20 Claims, 3 Drawing Sheets

METHOD AND DEVICE FOR CYLINDER RECOGNITION IN AN INTERNAL COMBUSTION ENGINE

BACKGROUND OF THE INVENTION

The present invention relates to a device and a method for cylinder sensing in an internal combustion engine (also referred to hereinafter as a motor).

In modern motor vehicles, motor management, i.e. control and sensing as well as monitoring of the essential features of the motor, is usually performed by using a control device with a computer.

In particular, ignition and fuel injection must be controlled jointly and adjusted to one another, with the respective operating state of the motor being determined precisely and taken into account in calculating the ignition timing and fuel metering.

An important item of information required by the computer to control ignition and fuel injection involves the position of the crankshaft. Usually a crankshaft sensor is provided to detect the crankshaft position. This crankshaft sensor is for example an inductive sensor that outputs a signal representing the rpm as well as a signal representing at least one selected crankshaft position. As a rule, the selected crankshaft position is top dead center (TDC) for one or more cylinders.

In ignition systems equipped with static high voltage distribution that use individual ignition coils, the computer requires additional information about the position of the camshaft, so that the ignition coil of the cylinder which is at or in the vicinity of TDC in the power stroke can be controlled. Otherwise the ignition coil of the cylinder that is in or in the vicinity of TDC in the exhaust stroke may be undesirably controlled, and caused to fire.

The position of the camshaft is usually detected using a camshaft sensor that delivers a signal when the camshaft is in a position in which a certain cylinder is at TDC in its power stroke for example. This known method is also termed cylinder 1 detection.

By linking the signals from the crankshaft sensor and the camshaft sensor, the ignition times and injection times of all the cylinders can be calculated unambiguously by the computer.

The method according to the prior art mentioned above has the disadvantage that two expensive sensors and correspondingly expensive wiring are required.

Accordingly, it is an object of the present invention to provide a device and a method for cylinder sensing in an internal combustion engine without requiring an additional camshaft sensor.

This object is achieved by a device for cylinder sensing in an internal combustion engine with a crankshaft sensor device to detect a crank angle and a predetermined crankshaft position and to output corresponding crankshaft signals; an ignition device for igniting the respective cylinders of the internal combustion engine by generating corresponding high voltage pulses in response to appropriate control signals; and a control device for receiving the crankshaft signals and outputting the control signals to the ignition device as a function of at least the crankshaft signals. The control device is designed such that, while receiving a crankshaft signal corresponding to a predetermined crankshaft position during a cylinder sensing phase, it outputs a control signal to generate a high-voltage pulse with a predetermined amplitude that can be reached in at least one specific cylinder; an ignition detection device to detect whether and/or at which ignition voltage the specific cylinder has been ignited by the high-voltage pulse, and output a corresponding ignition detection signal; and a cylinder sensing device to determine whether the specific cylinder in the predetermined crankshaft position is in its power stroke, based on at least the ignition detection signal.

This object as achieved by a method for cylinder sensing in an internal combustion engine with the following steps: detecting the crank angle and a predetermined crankshaft position and outputing corresponding crankshaft signals; generate a high-voltage pulse with a predetermined amplitude that can be reached in at least one specific cylinder when a predetermined crankshaft position is detected during a cylinder sensing phase; detecting whether and/or at what ignition voltage the specific cylinder has been ignited by the high-voltage pulse and output a corresponding ignition detection signal; and determining whether the specific cylinder is in the predetermined crankshaft position in its power stroke, based on at least the ignition detection signal.

The principle of the present invention is based on the fact that the ignition voltage at a predetermined crankshaft position, which is at or in the vicinity of TDC in the cylinder in question, depends on, among other things, the pressure prevailing in the cylinder. Thus the ignition voltage at 1 bar is typically 5 kV, while at approximately 5–7 bar it is typically about 13–20 kV. These pressures and ignition voltages can become established in two different cylinders of a motor when one cylinder is at or in the vicinity of TDC in its exhaust stroke (valves open) and the other cylinder is at or in the vicinity of TDC in its power stroke (valves closed).

In addition, by detecting the different ignition voltages, a determination can be made as to which of the cylinders is in the power stroke, so that the ignition sequence can be determined without requiring a conventional camshaft sensor.

For purposes of detection, in particular there is the first possibility that the high-voltage pulse supplied during the cylinder sensing phase is a normal high-voltage pulse, in other words, a high-voltage pulse whose amplitude can reach a typical value of approximately 13 kV required for ignition during the power stroke. In this case, the actual ignition voltage is detected and the result evaluated for cylinder sensing.

Secondly, the high-voltage pulse supplied during the cylinder sensing phase can be a reduced high-voltage pulse, i.e. a high-voltage pulse whose amplitude cannot reach the value of typically about 13 kV required for ignition during the power stroke, but only a value that is typically 7 kV and is sufficient for ignition during the exhaust stroke. In this case a determination is made as to whether a spark has actually occurred and the result is evaluated for cylinder sensing.

Once the initial sequence of the cylinders has been determined, all the subsequent ignition times until the motor next stops can be determined by sensing the crankshaft position using the crankshaft sensor. In other words, the cylinder sensing process needs only be performed during the starting phase of the motor. Therefore the fact that the usual camshaft sensor can be eliminated is an especially advantageous feature of the present invention.

According to a preferred embodiment, the predetermined crankshaft position is top dead center for the specific cylinder. This offers the advantage that the pressure differential between the power stroke and the exhaust stroke and hence the reliability of the measurement is greatest in this crankshaft position.

According to an additional preferred improvement according to claim 4, the predetermined amplitude is smaller than the amplitude required for ignition during the power stroke. This offers the advantage that no additional control expense for setting the value of the amplitude of the high-voltage pulse is required. In this case the ignition detection device is preferably so designed that it detects the ignition voltage of a specific cylinder. The ignition detection signal is then either the detected ignition voltage itself or a signal that can be derived from it unambiguously.

According to another preferred embodiment, the cylinder sensing device has a storage device for storing at least one ignition reference signal and a comparison device for comparing the ignition detection signal with the ignition reference signal. The ignition reference signal is preferably a reference voltage value chosen so that it is smaller than the voltage amplitude required for ignition when the cylinder in question is in the power stroke, but higher than the voltage amplitude required for ignition when this cylinder is in the exhaust stroke. The ignition reference signal for example can be 9 kV. This improvement is easy to implement but assumes that the voltage required for ignition is sufficiently different in the compressed and noncompressed states in order to permit reliable cylinder sensing.

According to still another preferred embodiment, a plurality of ignition reference signals from correspondingly different operating states of the internal combustion engine is stored in the storage device and the comparison device is so designed that it uses an ignition reference signal corresponding to the current operating state of the internal combustion engine for comparison. With such a design, consideration can be given to the fact that the ignition reference signal depends on the operating state of the motor. The term "operating state" therefore also subsumes internal parameters such as compression pressure as well as external parameters including the external temperature or air pressure.

In a further preferred embodiment, the cylinder detection device is so designed that it detects the ignition voltage of the specific cylinder during two successive periods of the AC ignition voltage. In this case the cylinder sensing device preferably has a storage device for storing the first ignition detection signal and a comparison device for comparing the first ignition detection signal with the second ignition detection signal. If the first ignition detection signal represents a higher ignition voltage, the specific cylinder is in the power stroke during the first revolution, otherwise during the second revolution.

In a further preferred embodiment, the ignition detection device is so designed that it detects the ignition voltage of at least two specific cylinders corresponding to one another during the same period of the AC ignition voltage. In this case the cylinder sensing device preferably has a comparison device for comparing the ignition detection signals corresponding to two specific cylinders. The simultaneous application of the ignition voltage to the two specific cylinders and the subsequent comparison of the detection signals has the advantage that the other influential parameters that affect ignition voltage, such as electrode spacing, gas composition, and gas dynamics for example, are as a rule the same in both cylinders and therefore compensate one another.

In another preferred embodiment, the predetermined amplitude, in other words the ignition reference signal, is smaller than the amplitude required for ignition during the power stroke.

Such a reduced amplitude can be achieved for example by reducing the energy supplied on the primary side to the ignition coil, specifically the primary current, or by reducing the steepness of the shutoff flank of the primary current.

In this case, the predetermined amplitude, in other words the ignition reference signal, is preferably higher than the amplitude required for ignition during the exhaust stroke.

In another preferred embodiment, the ignition detection device is preferably designed to determine whether the specific cylinder has been ignited, in other words it performs a YES/NO determination.

Preferably, the ignition device is designed to generate bipolar high-voltage pulses. In addition to the improvements listed above which are preferably made in a unipolar ignition device, there are additional advantageous possibilities for cylinder sensing with such a bipolar ignition device.

In another preferred embodiment the control device is designed to output a control signal for generating a bipolar high-voltage pulse with a different first and second predetermined amplitude as a function of the respective half-waves. In other words, in this improvement, the positive and negative half-waves of the ignition voltage have different values.

Preferably in this case the second predetermined amplitude is the amplitude required for ignition during the power stroke, and the first predetermined amplitude is smaller than the second predetermined amplitude and higher than the amplitude required for ignition during the exhaust stroke. In this case it is likewise possible to design the control device so that it increases the first predetermined amplitude during subsequent periods of the AC voltage to ignite a spark until the predetermined amplitude is higher than the amplitude required for ignition during the exhaust stroke.

According to another preferred embodiment, the ignition detection device is designed to determine whether the specific cylinder has been ignited during the first and/or second half-wave. If the specific cylinder has already been ignited in the first half-wave, it is in the exhaust stroke; otherwise it is in the power stroke.

Preferably the ignition detection device is located on the primary winding of the respective ignition coil. The advantage of this design is that it is readily possible to detect the time of appearance of an ignition spark in the primary igntion coil and to obtain from this the desired information about the pressure ratios in specific cylinders or their current cycles.

Advantageously, a start-signal generating device for generating a start signal when starting the internal combustion engine and outputting the start signal to the control device to determine the cylinder sensing phase is provided. This is advantageous since, as already mentioned above, cylinder sensing is required only at the beginning of operation of the motor. For example, the starting signal can be output with the ignition key in the starting position.

In the following the present invention will be explained in greater detail in conjunction with preferred embodiments and referring to the accompanying drawings.

BRIEF DESCRIPTION OF THE DRAWINGS

The preferred embodiments of the present invention will now be described more specifically with reference to the attached drawings, wherein.

DETAILED DESCRIPTION OF THE PREFERRED EMBODIMENTS

Figure 1:
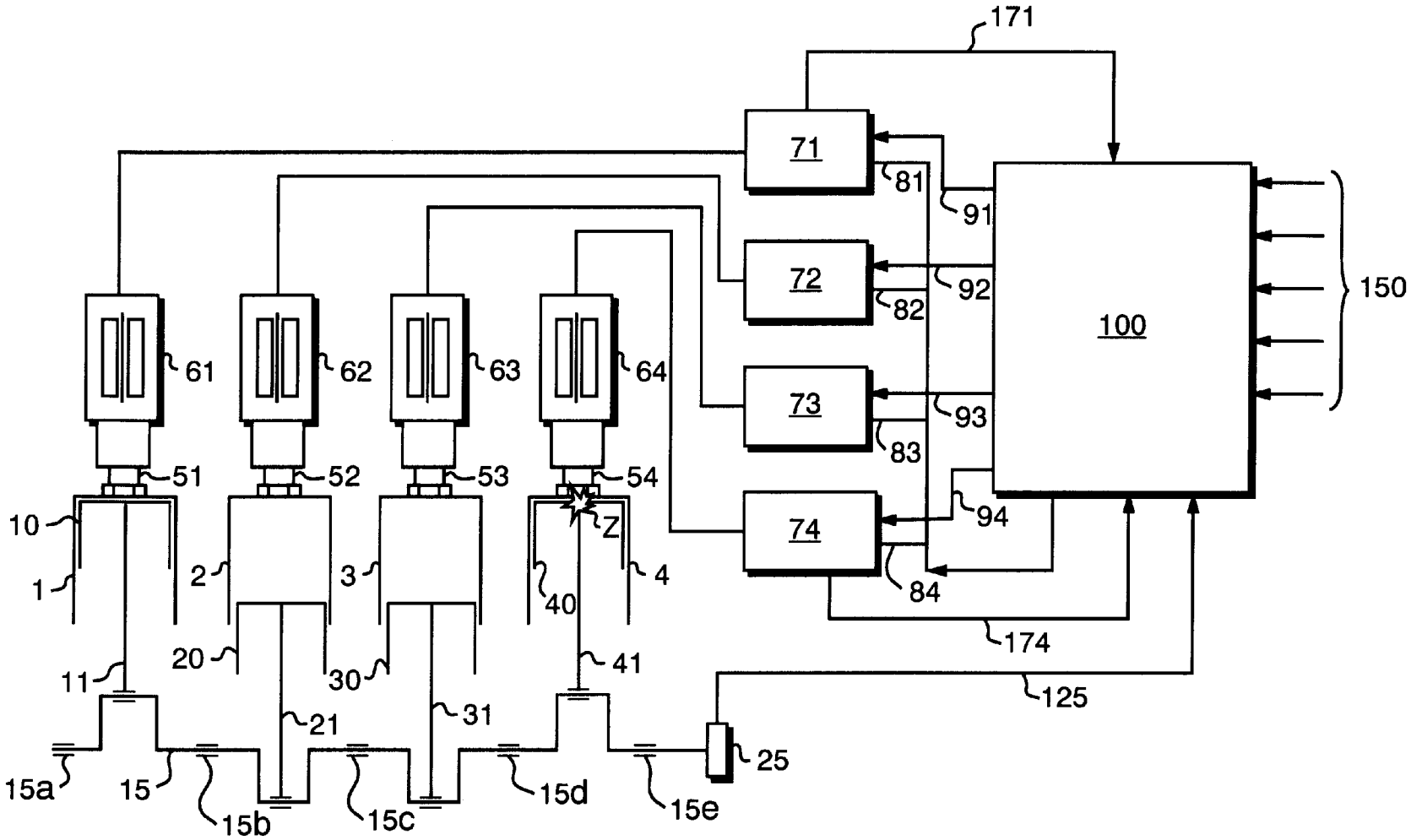
FIG. 1 is a schematic diagram of a preferred embodiment of the cylinder sensing device according to the invention.

In the figures, the same reference numerals refer to similar or functionally equivalent components.

FIG. 1 is a schematic diagram of a first preferred embodiment of the cylinder sensing device according to the invention.

In FIG. 1, reference numerals 1, 2, 3, and 4 refer to a first, second, third, and fourth cylinder of a four-cylinder four-cycle engine, said cylinders containing respectively pistons 10, 20, 30, and 40 connected by corresponding piston rods 11, 21, 31, and 41 with a crankshaft 15. Crankshaft 15 is mounted by suitable bearings 15*a*–15*e* in an engine block, not shown.

In the cylinder head of each cylinder 1, 2, 3, and 4 a respective spark plug 51, 52, 53, and 54 is provided, said spark plugs being provided with the necessary ignition voltage by corresponding ignition coils 61, 62, 63, and 64.

A corresponding ignition end stage 71, 27, 73, and 74 is connected with the primary of each ignition coil 61, 62, 63, and 64, said stages being controllable for supplying and cutting off the primary alternating current to and from ignition coils 61, 62, 63, and 64.

For this purpose, ignition end stages 71, 72, 73, and 74 are connected through respective control leads 81, 82, 83, and 84, that set the ignition voltage and/or ignition current, with a primary current source, not shown, advantageously located in a control device 100. The primary current source is operated with a supply voltage of typically 12 volts corresponding to the battery voltage.

In addition, control device 100 supplies control signals through control leads 91, 92, 93, and 94 to the respective ignition end stages 71, 72, 73, and 74 in order to control the duration and hence the beginning and end of the primary current supplied to the respective ignition coils. In this connection, express reference is made for purposes of disclosure to previously published EP 0 596 471 A1 of Applicant, in which the control of the ignition coils has already been disclosed in detail, with the signals determining the ignition energy and ignition duration.

The first ignition end stage 71 corresponding to first cylinder 1 and ignition end stage 74 corresponding to fourth cylinder 4 each have an ignition detection device on the primary in the form of a device that is not shown and serves to determine whether and/or at what ignition voltage the respective first or fourth cylinder 1 or 4 has been ignited by a high-voltage pulse that has been generated, and outputs a corresponding ignition detection signal. The device can be for example a timer on the primary side or a device for measuring di/dt. The corresponding ignition detection signals are supplied to control device 100 through signal leads 171 and 174 respectively.

A crankshaft sensor 25 is likewise mounted on crankshaft 15, by which the crankshaft position and the common top dead center point of first and fourth cylinders 1 and 4 can be detected. A corresponding crankshaft signal is supplied to control device 100 through a signal lead 125.

Finally, 150 refers to a plurality of additional signal leads that supply control device 100 with corresponding signals that characterize the operating state of the motor, for example temperature, rpm, position of ignition key, etc.

The operation of the cylinder sensing device so designed will be described in greater detail below.

A so-called cylinder sensing phase, defined by the start position of the ignition key, is reported to control device 100 through one of signal leads 150. When a crankshaft signal is received that corresponds to the common crankshaft position TDC of first and fourth cylinders 1 and 4 through signal lead 125 during this cylinder sensing phase, control device 100 generates a control signal to generate a high-voltage alternating current pulse with an amplitude of approximately 9 kV for example for first and fourth ignition end stages 71 and 74.

The amplitude of the high-voltage pulse, 9 kV, is chosen so that it is below the amplitude required for ignition when first and fourth cylinders 1 and 4 respectively are in the power stroke, but higher than the amplitude required for ignition when first and fourth cylinders 1 and 4 respectively are in the exhaust stroke.

Accordingly, no ignition spark is produced in cylinder 1 or 4 if that cylinder is in the power stroke (in this case cylinder 1), and an ignition spark Z is generated in the cylinder that is in the exhaust stroke (in this case, 4).

The ignition detection devices provided on the primary in first and fourth ignition end stages 71 and 74 determine whether the corresponding cylinders 1 and 4 have been ignited by the high-voltage pulse and supply a corresponding ignition detection signal through the respective control lead 171 or 174 to control device 100.

Using the sinusoidal shape of the ignition detection signal thus obtained, the control device, using an internal computer, determines which of the two cylinders 1 or 4 is in its power stroke (in the case illustrated, it is cylinder 1) and assigns a corresponding order as "cylinder 1" for establishing additional ignition points.

Figure 2:
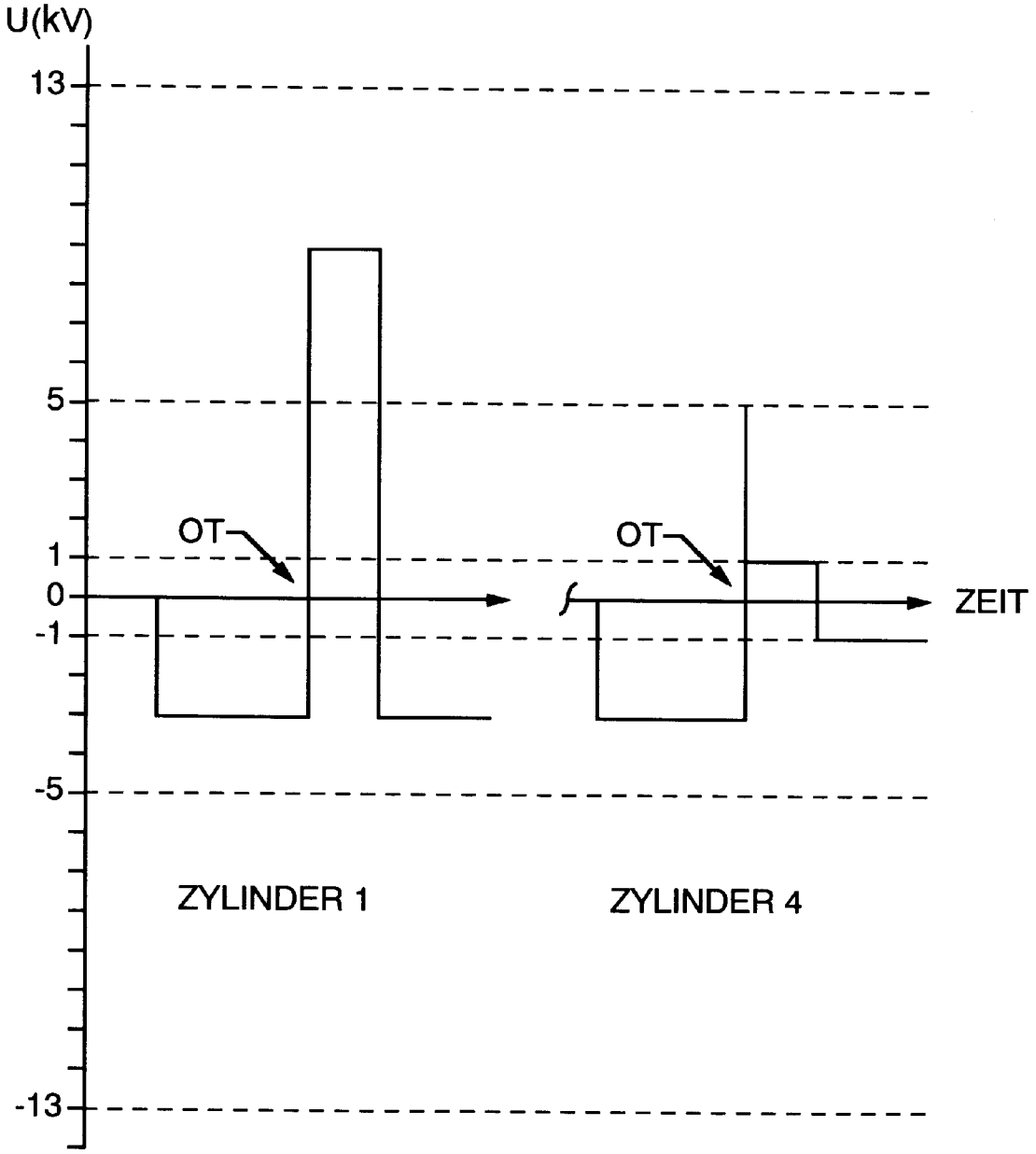
FIG. 2 is a schematic diagram of the ignition voltage pattern of the AC ignition voltage in the embodiment of the cylinder sensing device according to the invention as shown in FIG. 1 during a complete period of the AC ignition voltage in cylinders 1 and 4, with cylinder 4 igniting.

FIG. 2 is a view of the ignition voltage curve according to the embodiment described above for the cylinder sensing device according to the invention in FIG. 1.

In FIG. 2, time is plotted on the abscissa while the secondary voltage at spark plugs 51, 54 of first and fourth cylinders 1 and 4 is shown on the ordinate. It should be noted that the abscissa is divided and the same time process is shown for first cylinder 1 and fourth cylinder 4.

The secondary voltage curve of first cylinder 1 shown at the left in FIG. 2 begins with a negative range of about −3 kV which is produced by switching on ignition stage 71 and is of no further interest in this regard.

When the common TDC crankshaft position of first and fourth cylinders 1 and 4 is detected, the primary current of ignition end stage 71 with a steep flank is shut off and accordingly a high-voltage pulse with an amplitude u of about 9 kV that can be reached is produced, according to the equation:

$$u = L\ di/dt \tag{1}$$

Here, L represents the mutual inductance of ignition coil 61 and di/dt is the time derivative of the current curve at the moment that the primary current is shut off in the ignition end stage in question. TDC refers to the top dead center point of a cylinder.

It is evident from equation (1) that the value of the amplitude u that can be reached by the high-voltage pulse can be influenced by reducing the steepness of the shutoff flank and also by reducing the shutoff current.

Since in this case the amplitude u of the high-voltage pulse that can be reached is not sufficient to ignite first cylinder 1 which is in the power stroke, the secondary voltage curve shows a short plateau at 9 kV and then continues to decline.

The secondary voltage curve of fourth cylinder 2 shown at the right in FIG. 2 is different. Here again the high-voltage pulse begins with the negative section, not of interest here, and then at TDC shows a rise only up to about 5 kV, so that a spark forms prematurely in cylinder 4, since this is in the exhaust stroke. The ionization associated with the spark causes a drop in voltage to a so-called combustion plateau at about 1 kV, which lasts until the end stage shuts off. Then the secondary voltage at spark plug 64 drops off once more.

It should be pointed out that it is possible, instead of simultaneously detecting the voltage curve in first and fourth cylinders 1 and 4, to detect the voltage curve in both or in only one of these cylinders during two successive revolutions of the crankshaft, since the voltage curves shown occur alternatively in each of the cylinders with this type of control on the primary.

Figure 3:
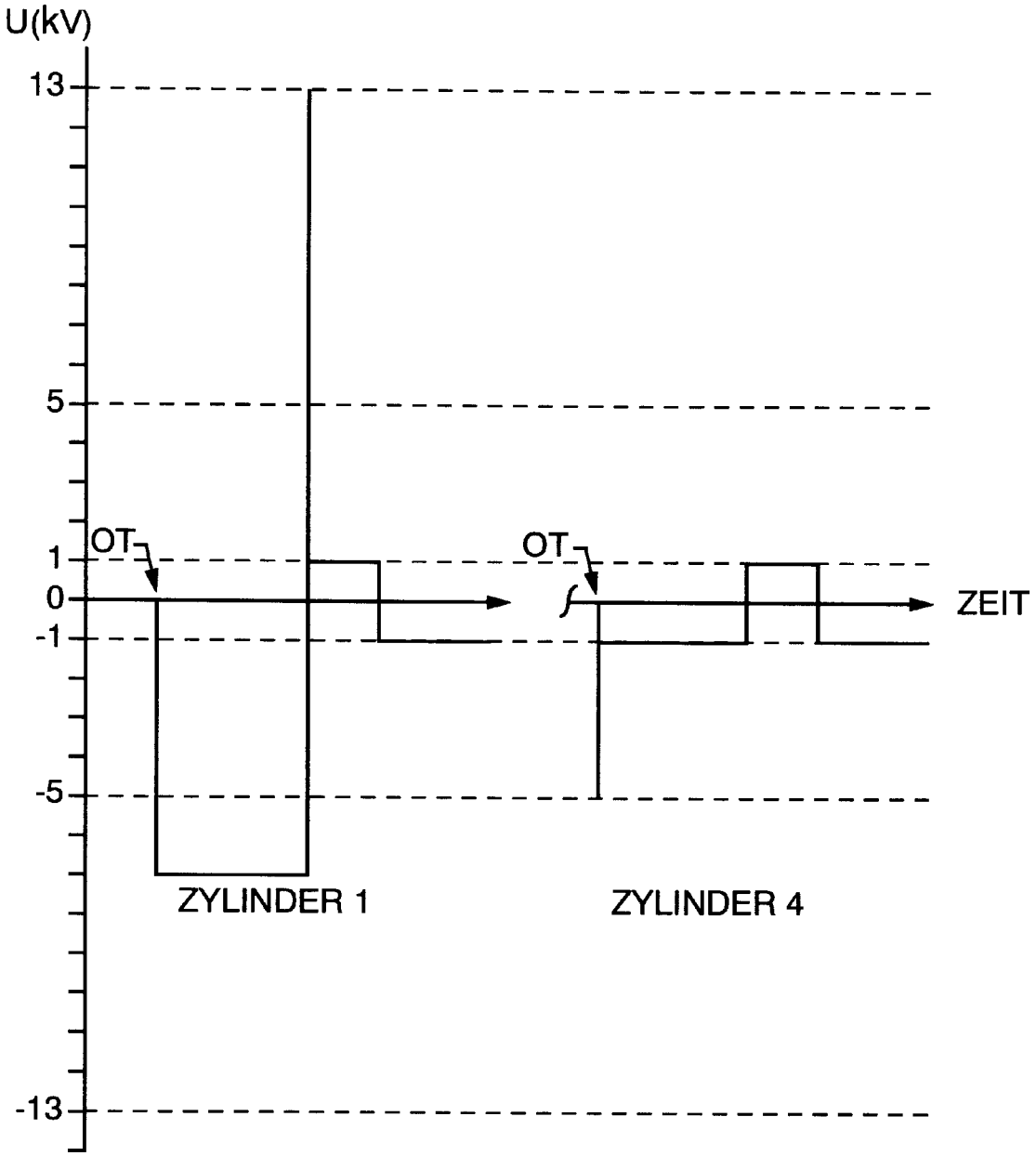
FIG. 3 is a similar view of the ignition voltage curve as shown in FIG. 2, with an ignition spark being generated in both cylinders 1 and 4 but at different points in time and being evaluated.

Another embodiment of the present invention will now be described with reference to FIG. 3.

In this embodiment as well, spark plugs 51, 52, 53, and 54, ignition coils 61, 62, 63, and 64, ignition end stages 71, 72, 73, and 74, and control device 100 are designed to generate bipolar high-voltage pulses. A high-voltage pulse consists for example of a negative first half-wave and a positive second half-wave, both of which serve to generate an ignition spark during normal operation.

Operation of the cylinder sensing device of this design proceeds as follows.

During the cylinder sensing phase which can be established by analogy with the above first embodiment, the amplitudes of the positive and negative half-waves are given different values.

The first negative half-wave is set so that it does not lead to the formation of an ignition spark in compressed first cylinder 1 that is in the power stroke. The second positive half-wave on the other hand has the same amplitude as in the normal ignition process. Thus, the second positive half-wave will generate an ignition spark in first cylinder 1.

Accordingly, fourth cylinder 4, when a similar bipolar high-voltage pulse is applied, ignites already at the first negative half-wave.

Cylinder sensing by cylinder sensing devices in first and fourth ignition end stages 71 and 74 takes place by virtue of the fact that the respective cylinder sensing device determines whether the cylinder in question was ignited during the first and/or second half-wave.

We claim:

1. Device for cylinder sensing in an internal combustion engine having a plurality of cylinders connected to a crankshaft, the device comprising:

a crankshaft sensor device for detecting a predetermined crankshaft position and outputting a corresponding crankshaft signal;

an ignition device for igniting at least one of the cylinders of the internal combustion engine by generating corresponding high-voltage pulses in accordance with corresponding control signals;

a control device for receiving the crankshaft signals and outputting the control signals to the ignition device as a function of at least the crankshaft signals;

with the control device capable of outputting a control signal for generating in the ignition device a high-voltage pulse with a predetermined voltage amplitude which is attained in at least one specific cylinder in a cylinder sensing phase during reception of the crankshaft signal;

an ignition detection device for detecting ignition of the specific cylinder by the high-voltage pulse of said predetermined voltage amplitude and outputting a corresponding ignition detection signal to the control device;

wherein the ignition detection device is connected to the primary winding of the respective ignition device and wherein the control device determines from at least the ignition detection signal whether the specific cylinder is in a power stroke in a predetermined crankshaft position.

2. Device for cylinder sensing according to claim 1, wherein the predetermined crankshaft position is at least approximately the top dead center (TDC) position of the specific cylinder.

3. Device for cylinder sensing according to claim 1, wherein the ignition detection device is adapted to detect the ignition voltage of at least two specific cylinders that correspond to one another during the same revolution of the crankshaft.

4. Device for cylinder sensing according to claim 1, wherein the ignition device generates bipolar high-voltage pulses.

5. Device for cylinder sensing according to claim 4, wherein the bipolar high-voltage pulse is generated in response to a control signal and has a first predetermnined amplitude at a first polarity and a second predetermined amplitude at the second polarity, wherein the first amplitude is different from the second amplitude.

6. Device for cylinder sensing according to claim 5, wherein the second predetermined amplitude is the amplitude required for ignition during the power stroke and the first predetermined amplitude is smaller than the second predetermined amplitude.

7. Device for cylinder sensing according to claim 6, wherein the first predetermined amplitude is larger than the amplitude required for ignition during the exhaust stroke.

8. Device for cylinder sensing according to claim 6, wherein the control device is capable of increasing the first predetermined amplitude during successive revolutions of the crankshaft until the first predetermined amplitude is larger than the amplitude required for ignition during the exhaust stroke.

9. Device for cylinder sensing according to claim 7, wherein the ignition detection device is capable of determining whether the specific cylinder was ignited by at least one of the first and second predetermined amplitudes.

10. Device for cylinder sensing according to claim 1, further comprising:

a start signal generating device for generating a start signal when starting the internal combustion engine and outputting the start signal to the control device for establishing a cylinder sensing phase.

11. Device for cylinder sensing according to claim 1, wherein the crankshaft sensor detects a crankshaft angle.

12. Device for cylinder sensing in an internal combustion engine having a plurality of cylinders connected to a crankshaft, the device comprising:

a crankshaft sensor device for detecting a predetermined crankshaft position and outputting a corresponding crankshaft signal;

an ignition device for igniting at least one of the cylinders of the internal combustion engine by generating corresponding high-voltage pulses in accordance with corresponding control signals;

a control device for receiving the crankshaft signals and outputting the control signals to the ignition device as a function of at least the crankshaft signals;

with the control device capable of outputting a control signal for generating in the ignition device a high-voltage pulse with a predetermined voltage amplitude which is attained in at least one specific cylinder in a cylinder sensing phase during reception of the crankshaft signal;

an ignition detection device for detecting ignition of the specific cylinder by the high-voltage pulse of said predetermined voltage amplitude and outputting a corresponding ignition detection signal to the control device;

wherein the control device determines from at least the ignition detection signal whether the specific cylinder is in a power stroke in a predetermined crankshaft position and wherein, the predetermined voltage amplitude is smaller than the voltage amplitude required for ignition during the power stroke.

13. Device for cylinder sensing according to claim 12, wherein the ignition detection device is adapted to detect the ignition voltage of the specific cylinder.

14. Device for cylinder sensing according to claim 12, wherein the predetermined voltage amplitude is higher than the voltage amplitude required for ignition during the exhaust stroke.

15. Device for cylinder sensing according to claim 14, wherein the ignition detection device is capable of determining whether the specific cylinder was ignited.

16. Device for cylinder sensing according to claim 14, wherein the ignition detection device is capable of determining during two successive revolutions of the crankshaft whether the specific cylinder was ignited.

17. Device for cylinder sensing according to claim 14, wherein the ignition detection device is capable of determining whether one of at least two specific cylinders corresponding to one another was ignited.

18. Device for cylinder sensing according to claim 12, wherein the control device is adapted to increase the predetermined voltage amplitude during successive periods of the crankshaft until the predetermined voltage amplitude is higher than the voltage amplitude required for ignition during the exhaust stroke.

19. Method for cylinder sensing in an internal combustion engine with the following steps:

determining of a predetermined crankshaft position and outputting a corresponding crankshaft signal;

generating a high-voltage pulse with a predetermined voltage amplitude that is attained in at least one specific cylinder when determining the predetermined crankshaft position during a cylinder sensing phase;

determining an ignition voltage at which the specific cylinder was ignited by the high-voltage pulse and outputting a corresponding ignition detection signal based on the ignition voltage; and determining whether the specific cylinder is in the predetermined crankshaft position in a power stroke, based on at least the determined ignition voltage.

20. Method for cylinder sensing according to claim 19, wherein the crankshaft sensor detects a crankshaft angle.

* * * * *